United States Patent [19]

Sédille et al.

[11] Patent Number: 4,519,211

[45] Date of Patent: May 28, 1985

[54] SUPERCHARGER DEVICE FOR AN INTERNAL COMBUSTION ENGINE

[75] Inventors: Marcel Sédille, Paris; Maurice Le Creurer, Taverny, both of France

[73] Assignee: Automobiles Peugeot/Automobiles Citroen, France

[21] Appl. No.: 498,696

[22] Filed: May 27, 1983

[30] Foreign Application Priority Data

Jun. 3, 1982 [FR] France ..... 82 09652

[51] Int. Cl.[3] ..... F01D 17/17; F02B 37/12

[52] U.S. Cl. ..... 60/602; 415/205

[58] Field of Search ..... 60/600, 601, 602, 603; 415/205

[56] References Cited

U.S. PATENT DOCUMENTS

| | | | |
|---|---|---|---|
| 3,313,518 | 4/1967 | Nancarrow | 415/205 X |
| 4,177,006 | 12/1979 | Nancarrow | 60/602 X |

FOREIGN PATENT DOCUMENTS

| | | | |
|---|---|---|---|
| 1155649 | 10/1963 | Fed. Rep. of Germany . | |
| 2143696 | 3/1973 | Fed. Rep. of Germany | 60/602 |
| 2151658 | 4/1973 | Fed. Rep. of Germany | 60/602 |
| 164622 | 12/1933 | Switzerland | 415/205 |
| 2057063 | 3/1981 | United Kingdom | 60/602 |

*Primary Examiner*—Michael Koczo

*Attorney, Agent, or Firm*—Burns, Doane, Swecker & Mathis

[57] ABSTRACT

This device comprises a turbocompressor C whose turbine 7 has a scroll 8*a* connected to two pipes 5, 6 each connected to the exhaust of a group of cylinders of the engine. The inlet of the scroll is divided by a partition 10 into two conduits 11, 12 which extend the two pipes 5, 6. A regulating flap 15 is provided and constitutes a movable wall of the scroll and includes two extensions 18, 19 which extend on each side of the partition 10 into the conduits 11, 12. This arrangement avoids the phenomenon of a counter-scavenging in the cylinders of the engine and improves the efficiency of the turbine.

7 Claims, 3 Drawing Figures

SUPERCHARGER DEVICE FOR AN INTERNAL COMBUSTION ENGINE

DESCRIPTION

The invention relates to a device for supercharging an internal combustion engine by means of a single turbocompressor.

In the internal combustion engines having four cylinders supercharged by a single turbocompressor having a radial wheel connected to a single exhaust manifold, it is well known that there exists a difficulty in the emptying of the ends of the cylinders, especially at high speeds.

This phenomenon may be explained in the following manner: when the piston of a cylinder is in the neighbourhood of its upper dead centre and the induction phase starts, the following cylinder in the ignition order is already in process of being emptied owing to the usual advance in the opening of its exhaust valve and the exhaust blast produces a pressure rise in the whole of the gas manifold. This pressure peak, which has its effect while the exhaust valve of the considered cylinder is still open, produces a counter-scavenging which has a harmful effect on the filling of the cylinder and accentuates the thermal stresses and thus limits a more intensive utilization of the engine.

Several arrangements are known for overcoming this drawback.

For example, two separate turbocompressors may be used into each of which discharges a group of cylinders sufficiently spaced apart in the order of ignition. This arrangement has the drawback of being expensive and resulting in a poor mean efficiency of the turbine which is not fed with gas during a part of the time, for example during roughly half the time with an engine having four cylinders.

A single tubine having a double scroll may also be used, each scroll being fed with gas as in the preceding case. This arrangement is not fully satisfactory, since it does not permit a sufficient drop in pressure in the non fed scroll when the pressure peak occurs in the fed scroll. Moreover, the overall size of a turbine having two scrolls is larger than the overall size of a turbine having a single scroll.

A pulse converter or blast converter has also been used which comprises two pipes fed in succession by the cylinders suitably staggered in the order of ignition and followed by a conduit possibly forming a diffuser connected to the inlet of a single turbine. If the section of the pipes is sufficiently small, it is possible to obtain in the non fed manifold a satisfactory pressure drop, but this arrangement has the double drawback of resulting in a loss of power in the pipes and of being efficient only in narrow limits of the operating speed of the engine so that it is inadapted to automobile applications.

Patent No. DE-A-2143696 discloses such a pulse or exhaust blast converter which has an adjustable section and comprises a scroll whose inlet is extended in the upstream direction and divided into two conduits each of which is provided with a control flap. The section of the turbine proper however remains fixed. Further, in this prior arrangement the flap is so disposed that the gases are projected toward the exterior of the scroll where it is well known that the velocities are normally of lower value than in the immediate vicinity of the wheel. Consequently, an expansion of the gas stream occurs at the outlet of the narrowed sections of the pulse converter and there is a large loss of efficiency. The object of the invention is to provide a more efficient solution to the problem explained hereinbefore and to provide a supercharging device which is satisfactory for all the operating speeds of the engine.

The invention is applied to a supercharger device for an internal combustion engine comprising a turbocompressor whose turbine includes a scroll connected to two pipes each of which is connected to the exhausts of a group of cylinders of the engine, the inlet of the scroll being divided by a partition into two conduits which extend the two pipes and each of which is provided with a regulating means. This device is characterized in that said regulating means comprise two extensions of a regulating flap which has a concave surface which constitutes a movable wall of the scroll.

According to other features of the invention:

- the partition is formed by a web having a triangular cross-sectional shape whose point points in the downstream direction with respect to the scroll;
- the flap pivotally mounted on the housing of the turbine by means of a pin includes at least one cylindrical surface having a circular section centered on said pin and cooperating with a conjugate surface formed in the housing of the turbine;
- two respectively upstream and downstream sets of conjugate surfaces are provided which are located at the ends of the flap relative to the flow of exhaust gas.

Another object of the invention is to provide a supercharged engine provided with such a device.

One embodiment of the invention will be described hereinafter with reference to the accompanying drawing in which:

FIG. 2 shows diagrammatically an internal combustion engine M having four cylinders 1, 2, 3 and 4, and partly a turbocompressor C.

Figure 2:
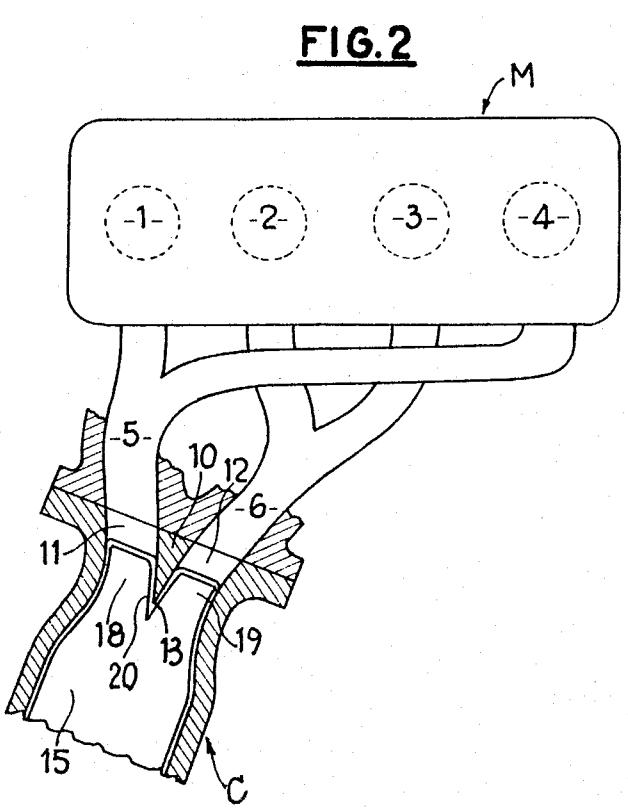
FIG. 2 is a diagram of the connection of the turbine to the engine with a partial sectional view taken along line 2—2 of FIG. 1.
Figure 3:
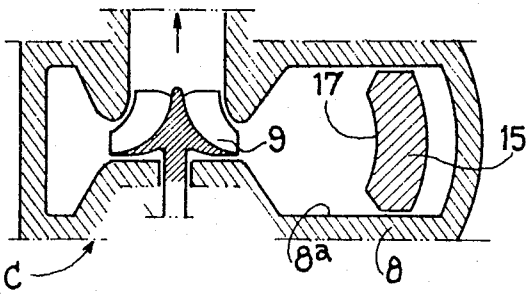
FIG. 3 is a sectional view taken along line 3—3 of FIG. 1.
Figure 1:
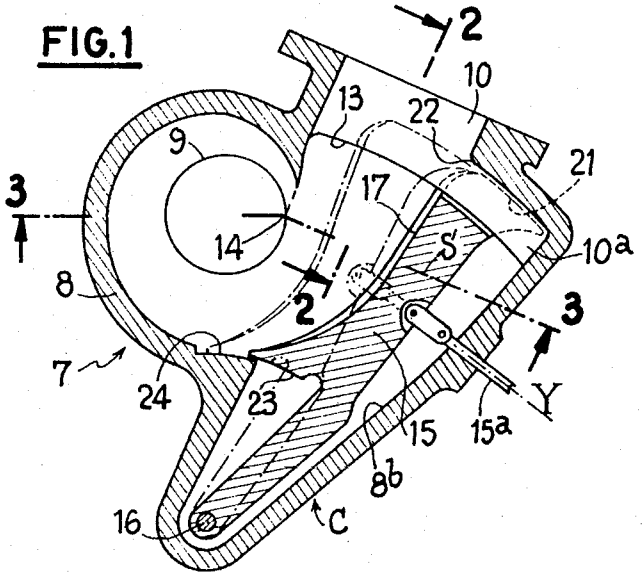
FIG. 1 is a sectional view taken in a plane perpendicular to the axis of rotation of a turbine arranged in accordance with the invention.

The exhaust gases from the engine are ducted toward two pipes 5 and 6 fed with exhaust gases by different cylinders suitably chosen in the order of ignition such that, in respect of each pipe, the cylinders connected thereto are offset by an angle of at least 220° measured on the crankshaft of the engine. In the illustrated case of an engine having four cylinders, the ignition order is 1, 3, 4, 2 and the pipe 5 is connected to the cylinders 1 and 4 and the pipe 6 is connected to the cylinders 2 and 3.

The pipes 5 and 6 are connected to a radial turbine 7 whose housing wall 8 defines a scroll 8*a* in which rotates a wheel 9 which drives a compressor (not shown).

The inlet of the scroll 8*a* is divided by a web 10 into two conduits 11, 12 which constitute extensions of the pipes 5 and 6 respectively. The web 10 has a roughly triangular cross-sectional shape and terminates at the downstream end (relative to the flow of the exhaust gases) in an edge 13 which is located upstream of a section S of the scroll 8*a* passing through its theoretical nose portion 14 so that the scroll can be suitably filled by the gas jet coming from each of the pipes 5 and 6.

A flap 15 received in a lateral cavity 8*b* of the housing wall 8 is mounted on the latter to pivot about an axis of a pin 16. The cavity communicates with the scroll through an aperture in which the flap 15 is pivotable. The flap has surface which 17 which is preferably concave and a movable part of the housing defining the scroll so that the section of the scroll adjacent to the scroll inlet can be regulated as a function of conditions by any known means, for example by means of a rod 15*a* having an axis Y or by means of a lever which acts directly on the pin 16.

The flap 15 has two extensions 18, 19 which respectively extend into the interior of the conduits 11 and 12. These extensions 18, 19 are separated by a slot 20 which allows the passage of the web 10 which is laterally extended at 10*a* into the cavity 8*b*. Each extension terminates in a cylindrical surface 21 which has a circular section centered on the pin 16 and cooperates with a conjugate surface 22 formed in the cavity 8*b* so as to provide at least an approximate seal at the upstream end of the flap. At least an approximate seal is also provided adjacent the downstream end of the flap by cooperation between two surfaces 23, 24 which are centered on the pin 16 and respectively formed on the flap 15 and in the scroll 8*a*.

With the arrangement just described, it is possible to regulate by means of a single element actuated by a single mechanism both the inlet section of the scroll 8*a* and the gas supply sections in the conduits 11 and 12 where they open into the scroll.

In this way, the sections of the conduits 11 and 12 of the scroll 8*a* are always adapted to the flow of the exhaust gases. Thus it is possible to obtain, for all the operating speeds of the engine, on one hand, a sufficiently low pressure drop in that one of the pipes 5 and 6 which is not fed with exhaust gas so as to avoid the drawback of the counter-scavenging in the cylinders and, on the other hand, a good efficiency of the turbine irrespective of the flow of the gases which permits in particular improving the supercharging at low operating speed. Consequently, it becomes unnecessary to provide a by-pass valve, whereas such a valve is usually indispensible for discharging excess gases when the operating speed of the engine becomes high. With the arrangement of the invention, all the gases are operative in the turbine and there is an improved general efficiency.

Further, the kinetic energy of the gas jets issuing from the pipes 5 and 6 may be of a value as high as necessary without any substantial loss resulting, since this energy is directly used in the wheel 9 and the gases are always directed as close as possible to the wheel.

It will be understood that the invention is applicable in the same way if the flap 18 is followed on the downstream side in the known manner by one or more other movable flaps adapted to lengthen the region of the scroll in which the section is regulated.

Having now described our invention what we claim as new and desire to secure by Letters Patent is:

1. A turbine for a turbocompressor of a supercharger device of an internal combustion engine, said turbine comprising a turbine wheel, a housing wall internally defining a first part of a scroll in which said turbine wheel is mounted to be rotatable about an axis, said housing wall further defining an aperture laterally disposed relative to said wheel and scroll, a flap movably mounted in said aperture and having a concave surface which defines a second part of said scroll completing said scroll with said first part, said scroll having an inlet for exhaust gases from said engine and a partition element dividing said inlet into two conduits which are respectively for connection to two exhaust pipes, each pipe being connected to exhaust outlets of a respective group of cylinders of the engine, said flap being movable in said aperture between a withdrawn position in which withdrawn position said concave surface of said flap defines a given section of passage of a part of the scroll adjacent to said inlet and a position in which said flap projects from said aperture and said concave surface of said flap defines a section of passage which is smaller than said given section of said part of the scroll adjacent to said inlet, said flap having two extension portions which are respectively cooperative with said two conduits so as to substantially completely open said conduits in said withdrawn position of said flap and to partly close said conduits in said projecting position of said flap.

2. A turbine according to claim 1, wherein the partition element is a web having a triangular cross-sectional shape and a point which points toward the scroll in the downstream direction relative to the direction of gas flow in the device.

3. A turbine according to claim 1, wherein the partition element has an extension portion which extends into said aperture and is located between said extension portions of said flap when said flap is in said withdrawn position.

4. A turbine according to claim 1, wherein the flap is mounted on said housing wall to pivot about an axis of a pivot pin and it has at least one cylindrical surface which has a part-circular section in a plane perpendicular to the axis of rotation of said turbine wheel and is centered on said axis of said pin and is cooperative with a conjugate cylindrical surface formed internally on said housing wall so as to substantially seal said scroll.

5. A turbine according to claim 4, comprising two cylindrical surfaces on the flap which are located respectively adjacent an upstream end and downstream end of the flap relative to the flow of the gases through the device, two surfaces conjugate with said two surfaces on the flap being provided on said housing wall to substantially seal said scroll.

6. A turbine according to claim 1, wherein said flap is pivotably mounted on said housing wall and is movable by pivoting about an axis parallel to the axis of rotation of said turbine wheel.

7. An internal combustion engine in combination with a supercharger device comprising a turbocompressor having a turbine comprising a turbine wheel, a housing wall internally defining a first part of a scroll in which said turbine wheel is mounted to be rotatable about an axis, said housing wall further defining an aperture laterally disposed relative to said wheel and scroll, a flap movably mounted in said aperture and having a concave surface which defines a second part of said scroll completing said scroll with said first part, said scroll having an inlet for exhaust gases from said engine and a partition element dividing said inlet into two conduits, said flap being movable in said aperture between a withdrawn position in which withdrawn position said concave surface of said flap defines a given section of passage of a part of the scroll adjacent to said inlet and a position in which said flap projects from said aperture and said concave surface of said flap defines a section of passage which is smaller than said given section of said part of the scroll adjacent to said inlet, said flap having two extension portions which are respectively cooperative with said two conduits so as to substantially completely open said conduits in said withdrawn position of said flap and to partly close said conduits in said projecting position of said flap, two exhaust pipes respectively connected to said two conduits, each exhaust pipe communicating with exhaust outlets of a respective group of cylinders of said engine.

* * * * *